US006925911B1

(12) United States Patent
Koppenhoefer

(10) Patent No.: US 6,925,911 B1
(45) Date of Patent: Aug. 9, 2005

(54) FLUID-OPERATED POWER TOOL

(75) Inventor: Peter Koppenhoefer, Portland, PA (US)

(73) Assignee: Unex Corporation, Mahwah, NJ (US)

( * ) Notice: Subject to any disclaimer, the term of this patent is extended or adjusted under 35 U.S.C. 154(b) by 0 days.

(21) Appl. No.: 10/770,209

(22) Filed: Feb. 2, 2004

(51) Int. Cl.[7] ..... B25B 13/46; B25B 17/00
(52) U.S. Cl. ..... 81/57.39; 81/57.36; 81/57.24
(58) Field of Search ..... 81/57.39, 57.36, 81/57.24, 57.35, 57.43, 62, 63, 163

(56) References Cited

U.S. PATENT DOCUMENTS

| | | | | |
|---|---|---|---|---|
| 523,238 | A * | 7/1894 | Ferguson | 403/163 |
| RE33,951 | E * | 6/1992 | Junkers | 81/57.39 |
| 6,260,444 | B1 | 7/2001 | Junkers | |
| 6,427,559 | B2 | 8/2002 | Junkers | |

* cited by examiner

*Primary Examiner*—Joseph J. Hail, III
*Assistant Examiner*—Alvin J Grant
(74) *Attorney, Agent, or Firm*—Michael J. Striker

(57) ABSTRACT

A fluid-operated power tool has a drive including a fluid-operator cylinder-piston unit, a first housing accommodating the drive, a lever-drive mechanism connected with the drive and powered by the latter and also engageable with a fastener for bolting applications, a second housing accommodating the lever-drive mechanism, the housings being interconnected so as to turn a fastener when the lever-drive mechanism is connected to the fastener and powered by the drive, and a connection for releasably connecting the housings with one another so that the housings are connectable with one another and disconnectable from one another, the connection including a female portion provided in one of the housings and a male portion provided in the other of the housings and engageable with the female portion for operatably connecting the first housing and the second housing with one another without subsequently requiring additional pins, screws and other means to provide a connection between the housings.

6 Claims, 3 Drawing Sheets

FLUID-OPERATED POWER TOOL

BACKGROUND OF THE INVENTION

The present invention generally relates to fluid-operated power tools. More particularly, it relates to power tools with interchangeable, lever-drive mechanisms for a variety of bolting applications.

Fluid operated power tools of this general type are known in the art. Some of such tools are disclosed in U.S. Pat. Nos. 6,260,444 and 6,427,559. In such tools lever-drive mechanisms can be interchanged for different bolting operations. Limited clearance, fluid-operated tools have an attachable hex link which contains a lever-drive mechanism and forms one housing, while another motor housing contains a fluid-operated drive unit. In all such tools the exchangeable link of one housing is connected to the other motor housing via screws and pins after the housings are assembled with one another. As a result, such screws and pins can loosen during the operation and end up inside a turbine, a compressor, or another equipment if they fall off during assembly. There are very strict requirements for such equipment, for example for turbines in that the turbine can not be fired up if there is any foreign material inside it, since it can cause the turbine blades to break off at high speeds and destroy the entire turbine. If pins or screws or other parts drop during assembly into the interior of the turbine, the recovery of such parts from an inner bottom of the turbine is extremely expensive, and in many instances requires robots which are not on site and can cause on-line delay by days.

Presently, all power stations use duct tape to tape all screws and pins onto the tool housing. As hydraulic devices are, however, subject to grease and oil, the tape sometimes loosens up and the parts drop anyway. Some users wire-connect pins to the tool housing, so that the pins do not drop into the interior of the tubing. However, when the connecting pin comes off, the link or the motor housing can fall down.

SUMMARY OF THE INVENTION

Accordingly, it is an object of the present invention to provide a fluid-operated power tool, which avoids the disadvantages of the prior art.

In keeping with these objects and with others which will become apparent hereinafter, one feature of the present invention resides, briefly stated, in a fluid-operated power tool, comprising drive means including a fluid-operator cylinder-piston unit; a first housing accommodating the drive means; a lever-drive mechanism connected with the drive means and powered by the latter and also engageable with a fastener for bolting applications; a second housing accommodating the lever-drive mechanism, wherein the two housings are interconnected so as to turn a fastener when the lever-drive mechanism is connected to the fastener and powered by the drive means; and connecting means for releasably connecting the housings with one another so that the housings are connectable with one another and disconnectable with one another, the connecting means including a female portion provided on one of the housings and a male portion provided on the other of the housings and engageable with the female portion for operatably connecting the first housing and the second housing with one another without subsequently requiring additional pins, screws and other means to provide a connection between the housings.

When the fluid-operated power tool is designed in accordance with the present invention, then during and after assembly of the housings with one another, no additional pins, screws, or other means are needed to form the connection, which could be lost during or after assembly and drop inside a corresponding equipment.

In accordance with an additional feature of the present invention the connecting means is formed so that they counteract forces created by the drive means during operation so as to counteract a tendency of the first housing accommodating the cylinder-piston unit to move along its axis away from the second housing and also to counteract a tendency of the first housing accommodating the cylinder-piston unit to move transversely to the axis.

When the fluid-operated tool is designed in accordance with these features, it solves a very important problem. There are two forces created by the cylinder-piston unit that push the lever/drive mechanism. The housing which accommodates the cylinder-piston unit wants to move back away from the housing which accommodates the lever-drive mechanism along the axis of the cylinder-piston unit. It also wants to move, depending on an angle between the axis of the cylinder-piston unit and the transverse lever arm axis, which changes during operation from, for example 110° at the beginning of the stroke to 75°. Under power, the cylinder-piston unit wants to twist relative to the housing accommodating the lever-drive mechanism. This means that not only the cylinder housing has to be stopped to slide backwards, but also upwards. When the fluid-operated power tool is designed in accordance with this new inventive feature, it solves this problem by stopping the housing accommodating the cylinder-piston unit from sliding backwards and upwards.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
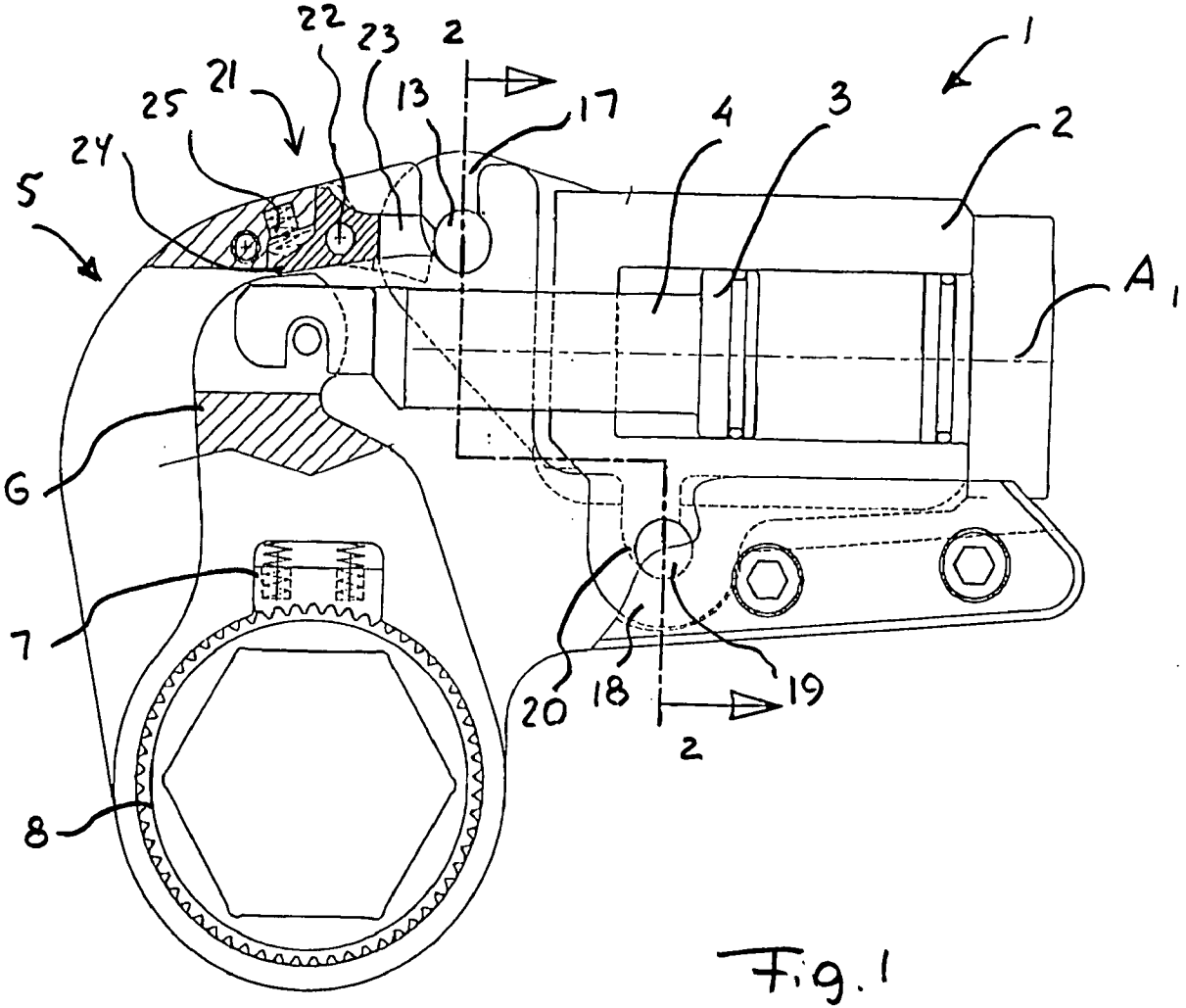
FIG. 1 is a view showing a fluid-operated power tool in accordance with the present invention in an assembled condition.
Figure 2:
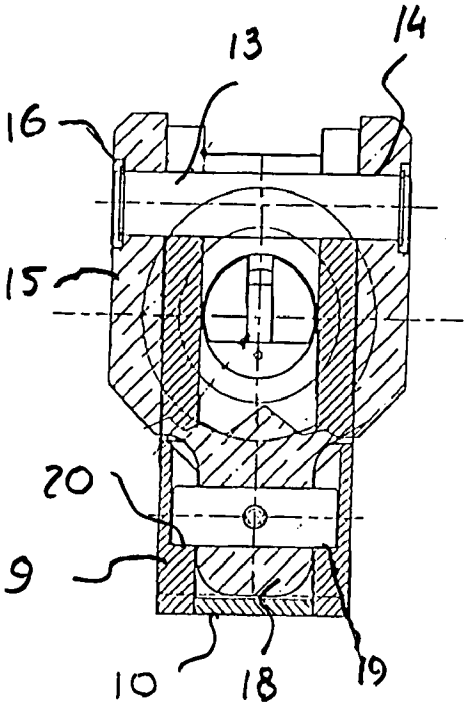
FIG. 2 is a view showing a section of the fluid-operated power tool of FIG. 1, taken along the line 2—2.

A fluid-operated power tool in accordance with the present invention has a first housing which is identified with reference numeral 1 and accommodates a drive means formed, for example, as a fluid-operated cylinder-piston unit. The fluid-operated cylinder-piston unit includes a cylinder 2 and a piston 3 provided with a piston rod 4 and displaceable in the cylinder 2.

The fluid-operated power tool further has a second housing which is identified with reference numeral 5 and accommodates a lever-drive mechanism. The lever-drive mechanism includes a lever 6 displaceable by the piston rod 4 and carrying a pawl 7 which engaging with teeth of a ratchet 8 arranged turnably in the lever 6. The lever 6 is movable between side plates 9, which together with a spacer 10 form the housing 5.

The above described construction of the fluid-operated power tool is known in the art and operates as follows:

During an advance stroke of the fluid-operated power tool, a power fluid is supplied into the cylinder 2, for example to the right side of the piston 3, and displaces the piston 3 with the piston rod 4 to the left, the lever 6 is turned by the piston rod and the pawl 7 turns the ratchet 8, so that a corresponding element, for example a socket, a projection, etc. cooperating with the ratchet engages a fastener and turns the fastener. During a return stroke the power fluid is withdrawn from the cylinder at the right side of the piston 3 or introduced into the cylinder at the left side of the piston 3, and the piston 3 together with the piston rod 4 is displaced in an opposite direction, so that the lever 6 is turned in an opposite direction and the pawl 7 is disengaged from the teeth of the ratchet. With a plurality of advance and return strokes, the fastener is tightened or loosened correspondingly.

In accordance with the present invention, the fluid-operated power tool is provided with connecting means which connects the housings 1 and 5 with one another, so that during an assembly of the housings 1 and 5 with one another, or after the assembly, no additional pins, screws or other parts have to be inserted into the housings to form the connection.

In the shown embodiment of the invention, the connecting means include two connection units which are preferably spaced from one another in a substantially vertical direction and in a substantially horizontal direction, on the view of FIG. 1. In other words they are spaced from one another preferably in the direction of an axis A1 of the cylinder-piston unit and also in the direction which is transverse to the axis.

The first connection unit of the connecting means includes a pin 13 which extends through throughgoing openings 14 in side portions 15 of the housing 1 and is fixed in the openings 14 by retaining rings 16. The first connection unit further includes upwardly open slots 17 provided in side plates 9 of the housing 5, into which the pin 13 is insertable. The slots 17 of the side plates 9 of the housing 5 form a female formation, while the pins 13 fixed in the side portions 15 of the housing 1 form a male formation which is insertable in the female formation.

The second connection unit of the connecting means includes a downwardly extending loop-shaped projection 18 provided in the cylinder 2 and holding a pin 19, and also slots 20 provided in the side plates 9 of the housing 5. The slots 20 in the side plates 9 of the housing 5 form a female formation, while the pin 19 in the cylinder 2 of the housing 1 forms a male formation which is insertable in the female formation.

As can be seen from the drawings, the two connection units are spaced from one another in two transverse directions, for example in the direction of the axis A1 and in the direction which is transverse to the axis A1. The same is true for the male and female formations. The male formations 13 and 19 are spaced from one another in two mutually transverse directions, and the female formations 17 and 20 are also spaced from one another in two mutually transverse directions.

In order to assemble the housings 1 and 5 with one another, the housing 5 is moved toward the housing 1, so that the pin 13 is inserted into the slots 17 and the pin 19 is inserted into the slots 20.

A locking mechanism is provided for locking the housings 1 and 5 with one another in the assembled condition. The locking mechanism includes a lever 21 which is turnable about an axis 22. The lever 21 has one arm 23 having for example a cam-shaped end, and another arm 24, so that the arms are located at opposite sides of the axis 22. A spring 25 pulls the arm 24 of the lever 21 upwardly in FIG. 1, so that the cam-shaped end of the arm 23 abuts against the pin 13 and prevents disengagement of the pin 13 from the slots 17.

In order to release the housings 1 and 5 from one another, a user depresses the arm 23 of the lever 21 downwardly so that its cam-shaped end no longer acts on the pin 13, thus allowing the pin 13 to move upwardly in the slots 17, so that the housing 1 can be displaced upwardly and the pins 13 and 19 can be disengaged from the slots 17 and 20 of the housing 5.

Figures 3, 4, 5:
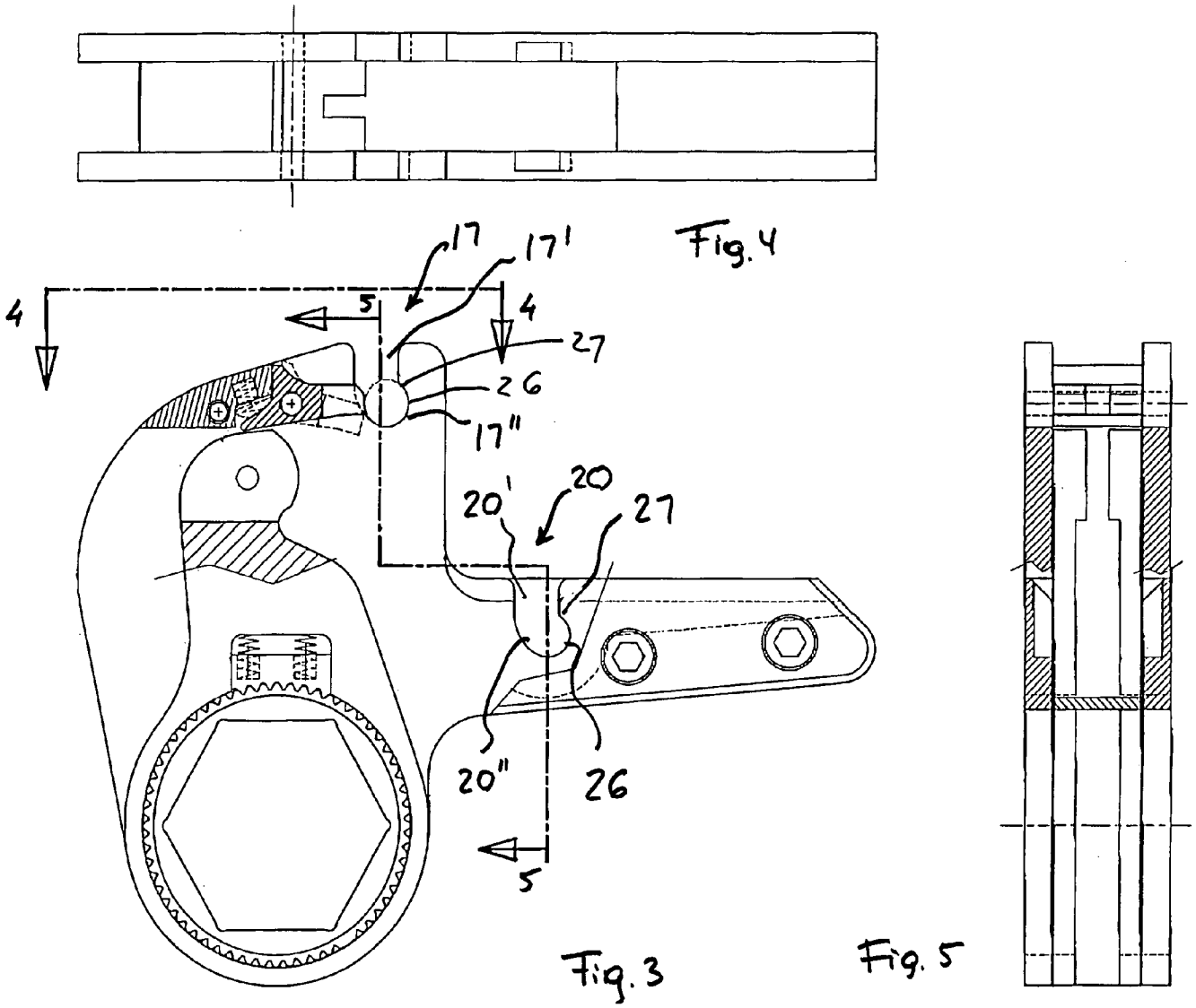
FIG. 3 is a view showing a lever-drive housing of the inventive fluid-operated power tool.
FIG. 4 is a view of the lever-drive housing of FIG. 3, as viewed in direction of the arrows 4—4.
FIG. 5 is a view showing a section of the lever-drive mechanism of FIG. 3, taken along the line 5—5.
Figure 7:
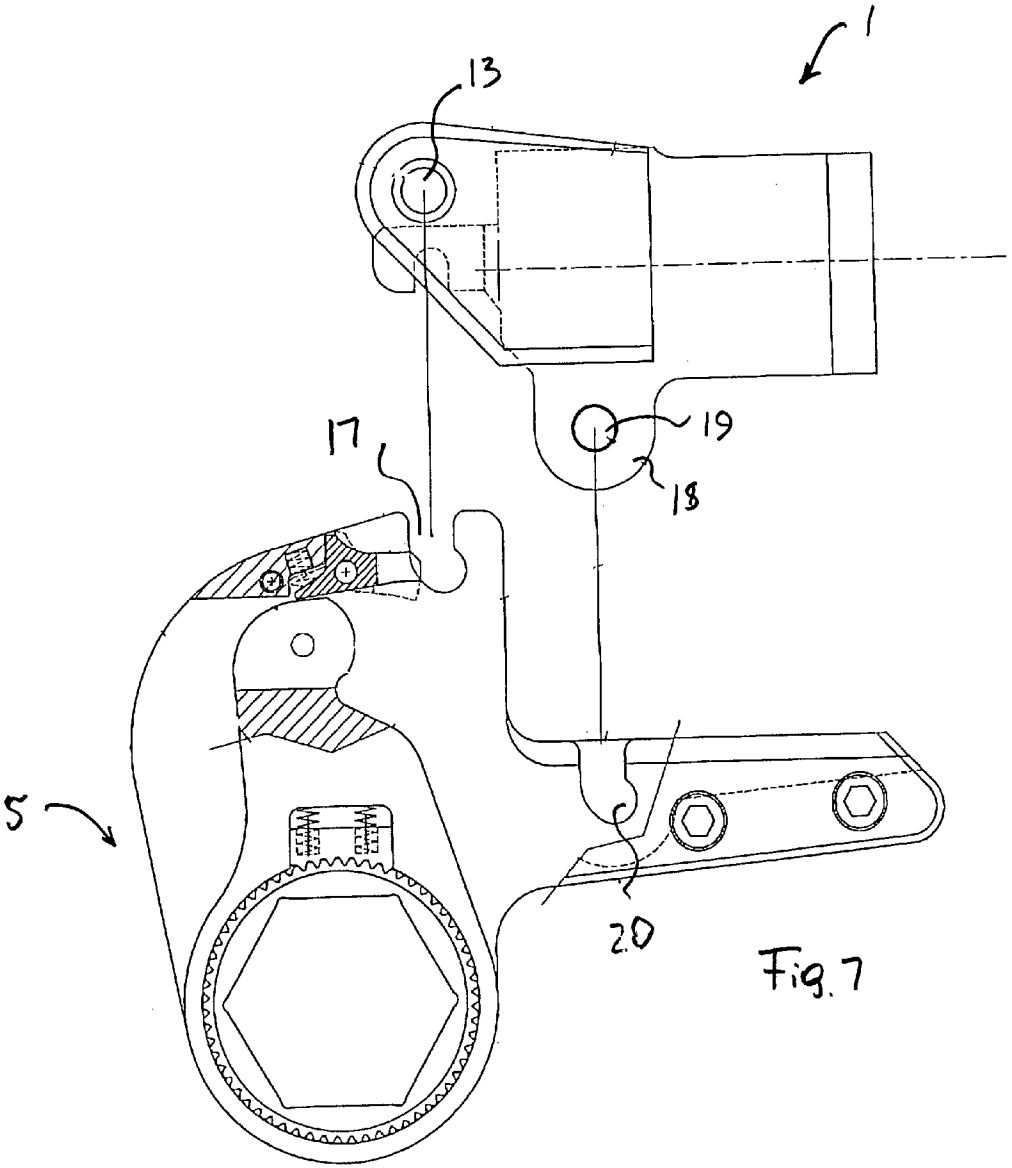
FIG. 7 is a view illustrating a process of assembling of the housings of the fluid-operated power tool in accordance with the present invention.
Figure 6:
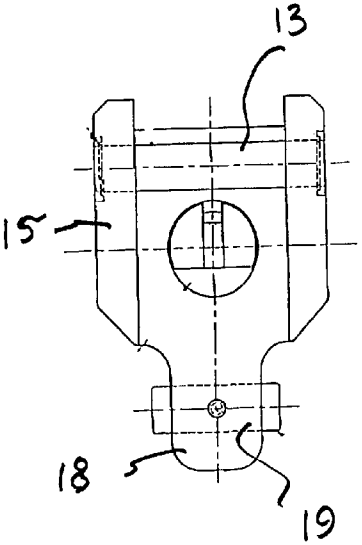
FIG. 6 is a view showing details of fixing pins associated with the housing of the fluid-operated power tool of the present invention, which accommodates a cylinder-piston unit.

The fluid-operated power tool in accordance with the present invention is designed so that the tendency of the housing 1 during operation to move axially in direction of the axis A1 from the housing 5 and to move transversely to the axis A1 is counteracted. In particular, as shown in FIG. 3, each of the slots 17 and 20 is formed so that it has one part extending in one direction, in particular in a vertical direction in FIG. 3 as identified with reference numerals 17' and 20', and another part which is offset in direction of the axis A1 from the first mentioned part 17' and 20' as identified with reference numerals 17" and 20". The slots 17 and 20 can have substantially the shape of letter J.

During the operation of the fluid-operated power tool the housing 1 can not move relative to the housing 5 in the axial direction of the axis A1 away from the housing 5 because the pins 13 and 19 abut against a side surface 26 of the slots 17 and 20. At the same time, the housing 1 can not move relative to the housing 5 transversely to the axis A1 upwardly, because the pins 13 and 19 abut against an upper surface 27 of the parts 17" and 20" of the slots 17 and 20.

It will be understood that each of the elements described above, or two or more together, may also find a useful application in other types of constructions differing from the types described above.

While the invention has been illustrated and described as embodied in fluid-operated power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fluid-operated power tool, comprising drive means including a fluid-operator cylinder-piston unit; a first housing accommodating said drive means; a lever-drive mechanism connected with said drive means and powered by the latter and also engageable with a fastener for bolting applications; a second housing accommodating said lever-drive mechanism, said housings being interconnected so as to turn a fastener when said lever-drive mechanism is connected to said fastener and powered by said drive means; and connecting means for releasably connecting said housings with one another so that said housings are connectable with one another and disconnectable from one another, said connecting means including a female portion which is connected with one of said housings, and also a male portion which is connected with the other of said housings and is engageable, in a connected condition, in said female portion for operatably connecting said first housing and said second housing with one another without subsequently requiring additional pins, screws and other means to provide a connection between said housings.

2. A fluid-operated power tool, comprising drive means including a fluid-operator cylinder-piston unit; a first housing accommodating said drive means; a lever-drive mechanism connected with said drive means and powered by the latter and also engageable with a fastener for bolting applications; a second housing accommodating said lever-drive mechanism, said housings being interconnected so as to turn a fastener when said lever-drive mechanism is connected to said fastener and powered by said drive means; and connecting means for releasably connecting said housings with one another so that said housings are connectable with one another and disconnectable from one another, said connecting means including a female portion provided in one of said housings, and a male portion provided in the other of said housings and engageable in said female portion for operatably connecting said first housing and said second housing with one another without subsequently requiring additional pins, screws and other means to provide a connection between said housings; and locking means which, subsequently to insertion of said female portion into said male portion, automatically lock said housings with one another, said locking means being actuatable by a user so as to unlock said housings from one another and to allow withdrawal of said male portion from said female portion and therefore disconnection of said housings from one another.

3. A fluid-operated power tool, comprising drive means including a fluid-operator cylinder-piston unit; a first housing accommodating said drive means; a lever-drive mechanism connected with said drive means and powered by the latter and also engageable with a fastener for bolting applications; a second housing accommodating said lever-drive mechanism, said housings being interconnected so as to turn a fastener when said lever-drive mechanism is connected to said fastener and powered by said drive means; and connecting means for releasably connecting said housings with one another so that said housings are connectable with one another and disconnectable from one another, said connecting means including a female portion provided in one of said housings, and a male portion provided in the other of said housings and engageable in said female portion for operatably connecting said first housing and said second housing with one another without subsequently requiring additional pins screws and other means to provide a connection between said housings, wherein said female portion has at least two female formations provided in said one housing and spaced from one another, wherein said male portion has two male formations provided in said other housing and spaced from one another, so that each of said male formations engages in a corresponding one of said female formations.

4. A fluid-operated power tool as defined in claim 3, wherein said female formations are spaced from one another in directions which are substantially transverse to one another, said male formations being also spaced from one another in said directions which are substantially transverse to one another.

5. A fluid-operated power tool, comprising drive means including a fluid-operator cylinder-piston unit; a first housing accommodating said drive means; a lever-drive mechanism connected with said drive means and powered by the latter and also engageable with a fastener for bolting applications; a second housing accommodating said lever-drive mechanism, said housings being interconnected so as to turn a fastener when said lever-drive mechanism is connected to said fastener and powered by said drive means; and connecting means for releasably connecting said housings with one another so that said housings are connectable with one another and disconnectable from one another, said connecting means including a female portion provided in one of said housings and a male portion provided in the other of said housings and engageable in said female portion for operatably connecting said first housing and said second housing with one another without subsequently requiring additional pins, screws and other means to provide a connection between said housings, wherein said connecting means is formed so that they counteract forces created by said drive means during operation so as to counteract a tendency of said first housing accommodating said cylinder-piston unit to displace along its axis away from said second housing and also to counteract a tendency of said first housing accommodating said cylinder-piston unit to displace transversely to said axis.

6. A fluid-operated power tool as defined in claim 5, wherein said female portion includes one part extending in one direction, and another part which is offset relative to said one part in a direction which is transverse to said one direction.

* * * * *